United States Patent [19]

Hollingsead et al.

[11] 4,453,797

[45] Jun. 12, 1984

[54] AVIONIC ELECTRICAL CONNECTOR MOUNTING APPARATUS

[75] Inventors: Robert A. Hollingsead, LaHabra; Clyde R. Pryor, Anaheim, both of Calif.

[73] Assignee: Hollingsead International Inc., Santa Fe Springs, Calif.

[21] Appl. No.: 398,861

[22] Filed: Jul. 16, 1982

Related U.S. Application Data

[63] Continuation of Ser. No. 252,361, Apr. 9, 1981, abandoned, which is a continuation of Ser. No. 118,481, Feb. 4, 1980, abandoned, which is a continuation of Ser. No. 878,901, Feb. 17, 1978, abandoned, which is a continuation of Ser. No. 718,979, Aug. 30, 1976, abandoned.

[51] Int. Cl.[3] ..... G12B 9/10

[52] U.S. Cl. ..... 339/132 B; 248/27.1

[58] Field of Search ..... 339/65, 66, 121, 125, 339/126, 132–134, 198 G, 198 H; 248/27.1, 27.3, 221.1, 221.2, 221.3; 269/47, 50, 51; 403/388, 408; 211/26; 361/417–420; 411/176

[56] References Cited

U.S. PATENT DOCUMENTS

| | | | |
|---|---|---|---|
| 137,382 | 4/1973 | Nagle | 411/192 |
| 1,814,858 | 7/1931 | Rutter | 411/107 |
| 2,294,896 | 9/1942 | Eby | 339/132 T |
| 2,386,732 | 10/1945 | Wohlhieter | 248/27.3 |
| 3,210,860 | 10/1965 | Lieberman et al. | 248/27.1 |
| 3,245,449 | 4/1966 | Mitchell | 411/176 |
| 3,278,144 | 10/1966 | Dixson et al. | 248/27.3 |
| 3,346,286 | 10/1967 | Wescott | 403/408 |
| 3,467,944 | 9/1969 | Hammell et al. | 339/125 R |
| 3,790,698 | 2/1974 | Engert | 339/126 R |
| 3,918,694 | 11/1975 | Laudick | 269/47 |

FOREIGN PATENT DOCUMENTS

| | | | |
|---|---|---|---|
| 212937 | 1/1961 | Austria | 339/132 R |
| 821075 | 11/1951 | Fed. Rep. of Germany | 339/132 R |
| 635762 | 1/1928 | France | 339/184 R |

*Primary Examiner*—Neil Abrams

*Attorney, Agent, or Firm*—Jackson, Jones & Price

[57] ABSTRACT

Accurate alignment of mating electrical connectors on avionic racking equipment is provided by a first circular alignment projection and a second alignment projection toleranced along at least one line for mating with alignment apertures in the electrical connector.

5 Claims, 4 Drawing Figures

AVIONIC ELECTRICAL CONNECTOR MOUNTING APPARATUS

This is a continuation application of Ser. No. 252,361 filed Apr. 9, 1981, now abandoned, which is a continuation of Ser. No. 118,481 filed Feb. 4, 1980, now abandoned, which is a continuation of Ser. No. 878,901, filed Feb. 17, 1978, now abandoned, which is a continuation of Ser. No. 718,979 filed Aug. 30, 1976, now abandoned.

BACKGROUND OF THE INVENTION

The subject invention relates generally to racking assemblies for avionic equipment, and more particularly to the proper alignment of electrical connectors associated with such racking assemblies. In the typical avionic racking system, a black box having one or more electrical connectors mounted on its rear surface is secured in a mounting tray. At the rear portion of the tray, there is located a surface mounted parallel to the back of the black box. On this surface are mounted one or more electrical connectors designed to mate with the connectors on the back surface of the black box.

In mounting the black box, maintaining alignment between the black box and tray connectors such that proper mating of connectors occurs has proved a serious and aggravating problem. To date, this problem has persisted without panacea.

With the advent of integrated circuitry and the accompanying increase in the number of contact pins within each electrical connector, the alignment problem has become increasingly critical. Today, it is not uncommon to find such electrical connectors with one hundred or more contact pins. Of course, a similar number of connections must be made to the electrical connector itself from the adjoining electronic circuitry. A misalignment often results in bent connector pins, broken connector shells and bowed support trays. Consequently, an entire airplane may be grounded while the one hundred or more connections are established to a replacement connector.

In the prior art, electrical connectors have been mounted to avionic racking equipment by means of screws. Typically, four mounting holes have been provided on the mounting flange of the electrical connector shell member, corresponding to four holes on the connector mounting plate member to which the connector is to be mounted. The centers of the holes on both the mounting flange and the mounting plate can be closely toleranced to assure a match between the mounting flange holes and the mounting plate holes. Furthermore, the center line of each electrical connector mounted on the avionic tray can be closely toleranced to align with the center line of the connector on the rear of the black box to maintain proper alignment between the corresponding mating connectors. Seemingly, when the screws are inserted in the mounting holes perfect alignment should result.

The problem with this mounting approach of the prior art and the starting point of this invention is the recognition that screws make poor alignment devices. Screws are typically produced by screw machines, and the variations in their size are such that tolerances in the size of the mounting holes are on the order of 0.015 to 0.020 inches. To compensate for the considerable amount of slop movement allowed by these tolerances, mating connectors have been mounted utilizing flexible bushings which provide a float off-center of their associated electrical connector. Such connectors mounted in bushings are typically characterized as "floating" whereas connectors mounted solely by screws are referred to as "hardmounted". Typically, this float off-center in on the order of 0.031 inches. With today's high-density connectors, the off-center play of both the trays and box-mounted connectors has facilitated rather than alleviated improper mating of connectors and consequent damage. Another phenomenon noted is that improper screw alignment in the bushings can result in the associated connector being locked in position or displaced rearwardly such that the hardmounted connector bottoms out and never makes effective electrical contact.

SUMMARY OF THE INVENTION

It is therefore an object of the invention to eliminate the electrical connector alignment problems of the prior art.

It is another object of the invention to introduce an approach to the alignment of complimentary mating electrical connectors which provides highly accurate alignment.

These and other objects and advantages are accomplished according to the invention by the provision of two highly toleranced projections on either the connector shell member or the connector mounting plate member and two mating highly toleranced apertures on the other member. The first mating projection and aperture is designed to restrain the connector from all motion other than a pivotal motion about the surface of the mounting plate member. The second projection and mating aperture then only need to be closely toleranced along one line in order to accurately restrain any tendency of the connector to pivot about the first mating projection and aperture.

In this manner, the attachment screws are relieved of their alignment duties and relegated to the task to which they are properly suited—that of fastening. The invention results in the reduction of the tolerance in off-center connector movement to 0.004 inches, making feasible the elimination of the need for providing any float in connectors located either on the black box or the mounting tray structure.

DETAILED DESCRIPTION OF THE PREFERRED EMBODIMENT

Figure 1A:
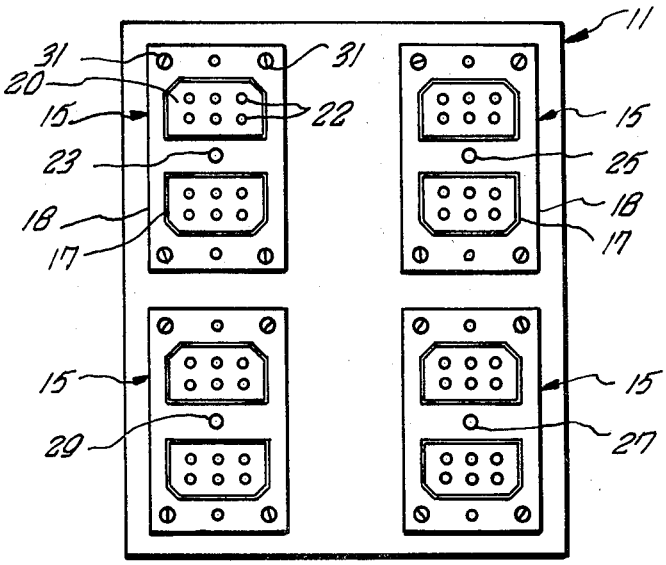
FIG. 1A. PRIOR ART
FIG. 1A illustrates the rear mounting surface or connector mounting plate of an avionic tray with electrical connectors mounted thereon in accordance with the prior art.
Figure 1B:
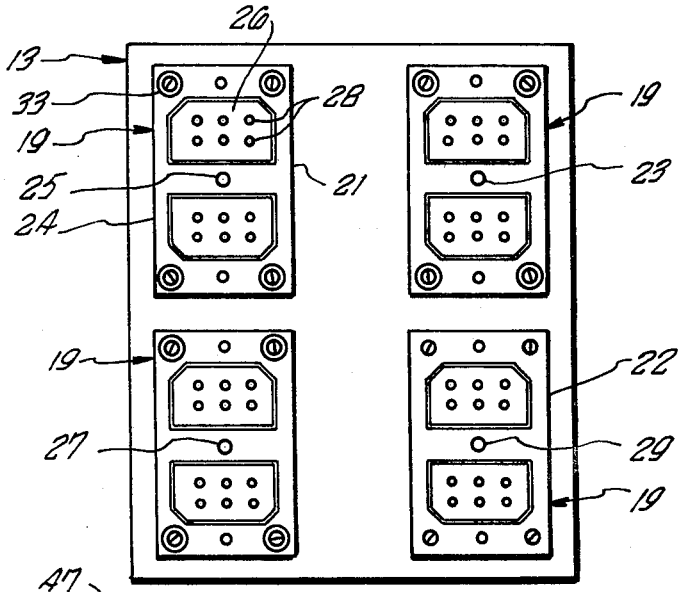
FIG. 1B. PRIOR ART
FIG. 1B illustrates the rear portion of a black box, or connector mounting plate, and electrical connectors mounted thereon according to the prior art for coupling to the connectors of FIG. 1A.

FIG. 1A illustrates a connector mounting plate member or surface 11 typically formed at the rear portion of an avionic tray. A black box, having a rear mounting surface 13 (connector mounting plate member) shown in FIG. 1B, is slideably mounted on the tray (not shown) which aligns the box such that the connectors mounted on the box surface 13 mate with those on the tray mounting surface 11. The four male tray or "rack mounted" connectors 15 have primary male alignment surfaces 17 which engage complementary receptacles 19 in four corresponding female connectors 21 mounted on the black box rear surface 13. The male connectors 15 include shell members 18, insulating block 20 and socket contacts 22. The female connectors 21 include shell members 24, insulating blocks 26 and pin contacts 28.

Corresponding pairs of connectors 15, 19 are mounted on respective common center lines 23, 25, 27 and 29 for alignment purposes. The rack mounted connectors 15 are "hardmounted" to the tray mounting surface 11 by means of four screws 31, one located at each of the four corners of each electrical connector 15. This manner of hardmounting the rack mounted connectors has been specified as a prior art standard, for example according to specification 404*a* of the Aeronautical Radio, Inc. (ARINC) standards for air transport equipment cases and racking.

Typically, it is specified that the box mounted connectors 19 are to be mounted to "float". This floating is typically accomplished by the use of flexible bushings 33 mounted between the attachment screws and enlarged screw holes in each floating connector 21. Typically, it is specified that one connector 22 of the multiple connectors be rigidly mounted. For example, for a four connector assembly such as illustrated in FIG. 1B, the above referred to ARINC standard provides that all except one of the multiple box connectors are to float radially 0.031 inches. The tolerances necessitated by the use of screws to mount and align the box and rack mounted connectors has resulted in an amount of off-center play which has been found to be at the root of the alignment problems of the prior art.

Figure 2:
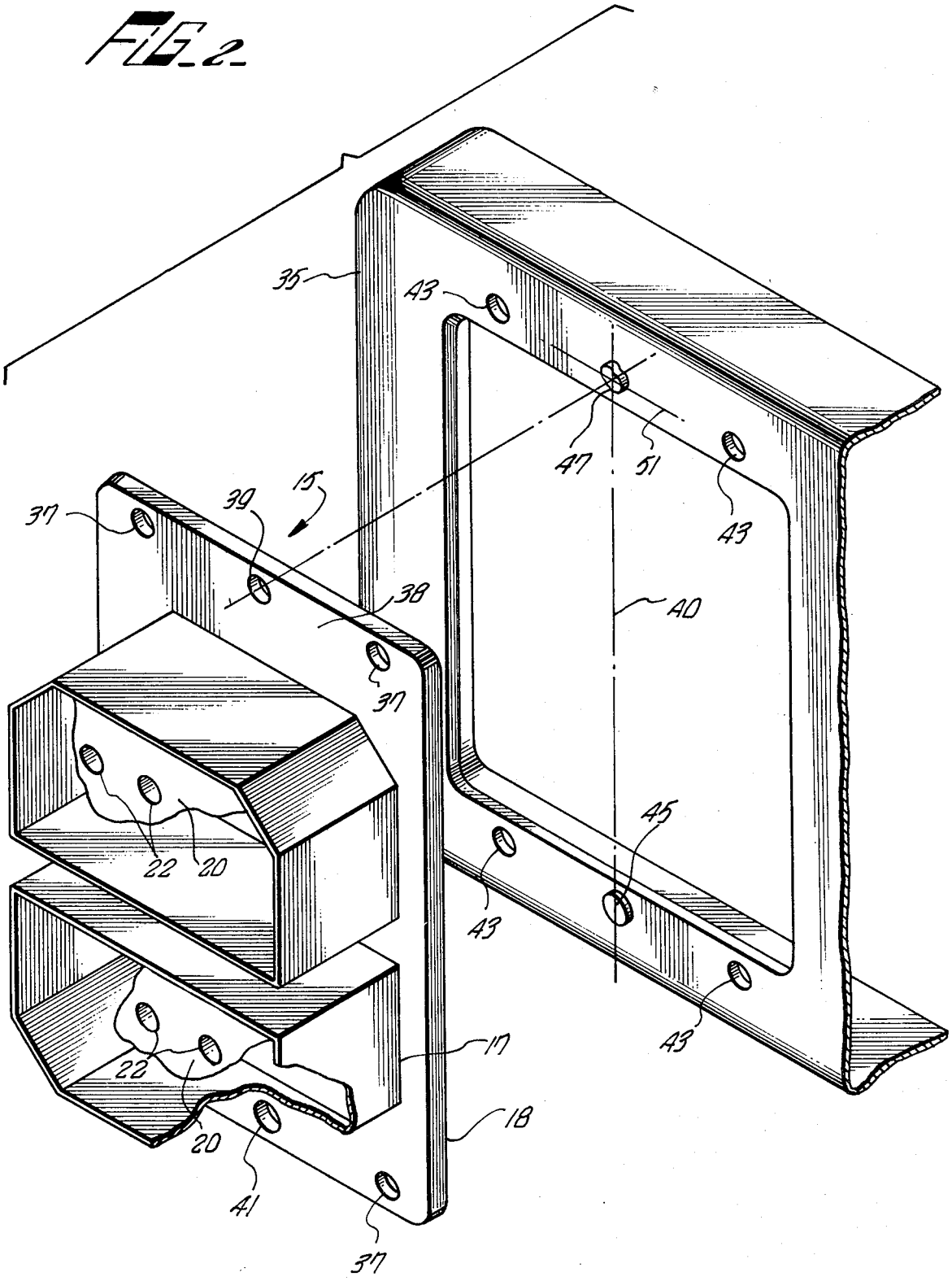
FIG. 2 is an exploded perspective of the electical connector mounting apparatus of the preferred embodiment of the invention.

The approach of the invention for solving this problem is shown in FIG. 2, which illustrates a single male electrical connector 15 with shell member 18, and an insulating block 20 (partially broken away) and socket contacts 22. FIG. 2 also illustrates the tray mounting plate member or surface 35 to which the connector is to be mounted. The shell member 18 of the connector 15 is provided with four attachment apertures 37 and two circular alignment apertures 39, 41. The alignment apertures 39 and 41 are spaced along a vertical axis 40. The tray mounting surface or connector mounting plate 35 has circular attachment apertures 43 aligned axially with the circular attachment apertures 37 on the mounting flange 38 of the shell member 18 of the electrical connector 15.

The tray mounting surface 35 also bears two alignment projections 45, 47. The first alignment projection 45 is in the shape of a circular cylinder with an outside diameter (closely toleranced) to fit snugly within the circular aperture 41. This projection may be formed by punch and die operation. Because of the use of a circular shape for the projection 45, a highly toleranced retention is then only necessary in one direction to prevent rotation about the first projection 45 and maintain the flange 38 of the shell member 18 in a tight and accurately aligned mounting position.

This alignment function is provided by accurately tolerancing the horizontal axis 51 of a substantially elliptical projection 47. While it is preferred that the shape of the projection 47 be substantially curved as it recedes from an intersection with the horizontal axis 51, the critical dimension is the length of the horizontal axis and no close tolerancing is necessary outside of this dimension.

The first aperture 41 and projection 45 serve to prevent relative movement of the connector 15 and mounting plate member 35 adjacent the first aperture along both the vertical and horizontal axes and the second aperture 39 and projection 47 serve to prevent relative movement of the connector and mounting plate member adjacent the second aperture along the horizontal axis.

The two projections 45, 47 cooperate with the mating apertures to provide a highly accurate alignment for the electrical connector 15. The possible movement off-center of the electric connector 15 is reduced from the prior art 0.015 to 0.020 inches to 0.004 inches or less, eliminating any noticeable movement of the electrical connector 15. Since the connector 15 is solely positioned by the projections 45, 47, the screws passing through the alignment apertures 37, 43 serve only to attach the connector to the surface of the tray mounting surface 37 and can assert no influence over the alignment of the connector 15. Since the alignment and radial dimensioning of the apertures 37, 39, 41, 43 and the projections 45, 47 can be controlled to a high degree of accuracy, the relatively low tolerance of the attachment screws is effectively compensated for.

The connector shell member 18 may be provided with projections e.g. 45 and 47 and the connector mounting plate member 35 may be provided with the mating apertures e.g. 39, 41 if desired.

Figure 3:
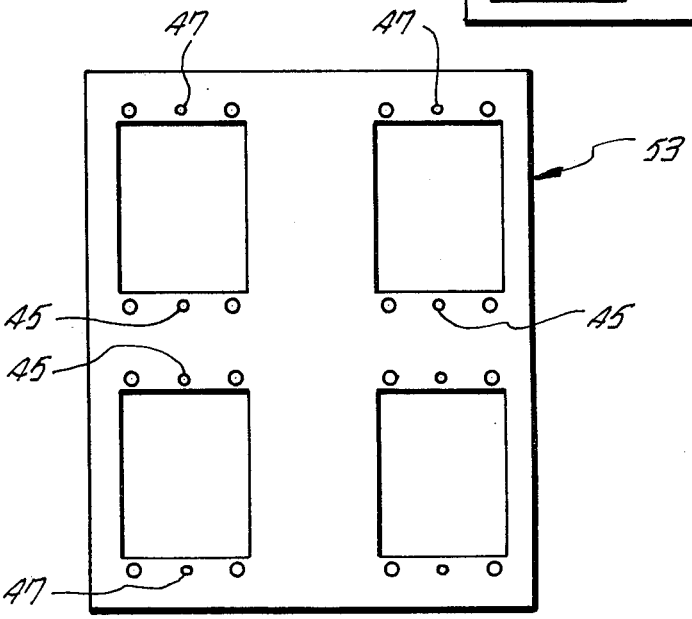
FIG. 3 illustrates a plurality of electrical connectors according to the preferred embodiment of the invention in a configuration which may mate with that of FIG. 1B.

FIG. 3 illustrates a mounting scheme for rack-mounted connectors according to the invention. In this configuration, all four rack-mounted connectors are aligned by respective pairs of alignment projections 45, 47 formed as part of a rear tray mounting surface 53. Screws are used only to attach the connectors as discussed above with respect to FIG. 2. Because of the tight tolerancing afforded, the float of the box connectors may also be eliminated, if a mounting scheme according to FIG. 3 is also employed on the rear box surface.

As may be apparent, many modifications and changes and adaptations may be made in the preferred embodiment of the invention just described without departing from the scope and spirit of the invention. It is therefore to be understood that, within the scope of the appended claims, the invention may be practiced other than as specifically described above.

What is claimed is:

1. In an avionic racking system having an electrical connector shell member defining spaced attachment apertures and a connector mounting plate member defining a tray mounting surface and a plurality of attachment apertures which match the attachment apertures in the connector shell, means for accurately aligning an electrical connector shell with respect to the tray mounting surface, comprising:

a first alignment projection rigidly affixed to either said shell member or said mounting plate member, said first alignment projection arranged to mate with a first alignment aperture on the opposite member, said first alignment aperture being displaced from the attachment apertures, said first alignment projection and first alignment aperture coacting to restrain movement of the connector shell with respect to the mounting plate along either of two perpendicular axes in a plane perpendicular to the axis of said first projection; and a second alignment projection rigidly affixed to either said shell member or said mounting plate member, said second alignment projection arranged to mate with a second alignment aperture on the opposite member, said second alignment aperture being displaced from the attachment apertures, said second alignment projection having a non-circular cross section and arranged to mate with said second alignment aperture so that its greatest cross-sectional dimension is perpendicular to the axis along which said first alignment projection restrains movement of the connector shell, thereby precisely locating the connector shell with respect to the mounting plate in a direction perpendicular to a line drawn between the projections.

2. The combination as defined in claim 1 wherein the apertures and projections on said mounting plate and shell members locate one with respect to the other to a tolerance on the order of 0.004 inches.

3. In an avionic racking assembly, including a mounting plate member for receiving an electrical connector member, said electrical connector member comprising one mating half of a two-part electrical connector, the mounting apparatus comprising:

corresponding attachment apertures in said connector member and said mounting plate member;

screw means for attaching said connector member to said mounting plate member through each of said attachment apertures;

first and second alignment apertures in one of said members, said alignment apertures being displaced from one another and from said attachment apertures;

a first projection means, on the member not having the alignment apertures, for engaging the inner periphery of the first alignment aperture at least at opposite points along a first axis for preventing movement between the connector and mounting plate members along said axis; and a second projection means, on the member not having the alignment apertures, for mating with said second aperture, said second projection means having an elliptical cross-section and being dimensioned to precisely locate said electrical connecting member with respect to said mounting plate member along a line perpendicular to the first axis of the first projection means, said first and second apertures and first and second projection means determining a unique alignment of said connector member with respect to said mounting plate member.

4. Electrical connector mounting apparatus comprising:

a mounting plate attached to avionic racking equipment, said mounting plate having a plurality of first apertures therein;

a mating portion of a two-part electrical connector, said mating portion having a plurality of second apertures located to face opposite said first apertures;

means insertable in said first and second apertures for fastening said portion of the electrical connector to said mounting plate;

a first and a second circular alignment aperture located on the periphery of the portion of the electrical connector fastened to said mounting plate and spaced apart from said second apertures;

a first projection means on said mounting plate of circular cross section having its entire circumference critically toleranced to mate with said first alignment aperture such that said mating portion may only pivot with respect to the center of said cross section; and a second projection means on said mounting plate of non-circular cross section with its greatest cross sectional dimension being perpendicular to a line drawn between the first and second projection means, the second projection means arranged to fit within said second alignment aperture for preventing pivoting of said mating portion about said center.

5. In an avionic racking system having an electrical connector shell member defining spaced attachment apertures and a connector mounting plate member defining a tray mounting surface and a plurality of attachment apertures which match the attachment apertures in the connector shell, means for accurately aligning an electrical connector shell with respect to the tray mounting surface, comprising:

said connector shell member or said mounting plate member further having a first and a second alignment aperture, both apertures being displaced from one another and from the attachment apertures;

a first alignment projection carried by the member not having the alignment apertures therein, said projection arranged to mate with the first alignment apertures to restrain movement of the connector shell with respect to the mounting plate along either of two perpendicular axes in a plane perpendicular to the axis of the projection; and a second alignment projection carried by the member not having the alignment apertures therein, said projection being generally elliptical in cross section and arranged to mate with the second alignment aperture with its greatest cross-sectional dimension perpendicular to the axis along which said first alignment projection restrains movement of the connector shell, thereby precisely locating the connector shell with respect to the mounting plate in a direction perpendicular to a line drawn between the projections.

* * * * *